US008632234B1

(12) United States Patent
Lowe et al.

(10) Patent No.: US 8,632,234 B1
(45) **Date of Patent: *Jan. 21, 2014**

(54) LED AND FIBER OPTIC RING PATHWAY LIGHT

(75) Inventors: Tien S. Lowe, Cooper City, FL (US); Mark Velutini, Alpharetta, GA (US); Eli E. Rivera, Plantation, FL (US); Joe Zhou, Guangdong (CN); Francisco Biancuzzo, Fort Lauderdale, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 69 days.

This patent is subject to a terminal disclaimer.

(21) Appl. No.: 13/315,578

(22) Filed: Dec. 9, 2011

Related U.S. Application Data

(63) Continuation-in-part of application No. 13/229,307, filed on Sep. 9, 2011.

(51) Int. Cl.
*F21V 7/04* (2006.01)

(52) U.S. Cl.
USPC ..... 362/555; 362/153.1; 362/431

(58) Field of Classification Search
USPC ..... 362/153.1, 430, 431, 249.02, 551, 555, 362/576
See application file for complete search history.

(56) References Cited

U.S. PATENT DOCUMENTS

| | | | | |
|---|---|---|---|---|
| 3,777,138 | A * | 12/1973 | Metzler | 362/235 |
| 5,226,721 | A | 7/1993 | Stokes | |
| 6,357,892 | B1 | 3/2002 | Beadle | |
| 6,784,357 | B1 * | 8/2004 | Wang | 136/244 |
| 6,874,905 | B1 | 4/2005 | Beadle | |
| 7,021,787 | B1 | 4/2006 | Kuelbs | |
| 7,083,315 | B2 * | 8/2006 | Hansler et al. | 362/559 |
| 7,192,155 | B2 * | 3/2007 | Morrow et al. | 362/153.1 |
| 7,204,608 | B2 | 4/2007 | Beeman | |
| 7,387,409 | B1 | 6/2008 | Beadle | |
| D574,532 | S | 8/2008 | Lee | |
| 7,841,734 | B2 * | 11/2010 | Wilcox | 362/153 |
| 8,002,428 | B2 * | 8/2011 | Boyer et al. | 362/153.1 |
| 8,382,347 | B2 * | 2/2013 | McCanless | 362/431 |
| 2005/0002183 | A1 | 1/2005 | Wardzala | |
| 2006/0203471 | A1 | 9/2006 | Hodges | |
| 2008/0074867 | A1 * | 3/2008 | Chen | 362/183 |
| 2010/0084985 | A1 | 4/2010 | Woytowitz | |

* cited by examiner

*Primary Examiner* — John A Ward

(74) *Attorney, Agent, or Firm* — Brian S. Steinberger; Law Offices of Brian S. Steinberger, P.A.

(57) ABSTRACT

Pathway and landscape lights, in particular to devices, apparatus, systems and methods of using ground directed pathway and landscape lights with a single or perimeter spaced apart LED (light emitting diode) light sources on a disc mount, with or without an optical fiber arranged in a ring pattern about a perimeter edge of the mount. A light shade lens can have an upper end attached to the lower face of the disc mount, and a bottom end attached to a ground engaging post, so the light emitted from the mount is directed in a 360 degree outwardly expanding direction expanding outward on the ground surface where the ground engaging post is in the center of the 360 degree expanding illumination. A low voltage power source can be used. Alternatively, the light can be solar powered. The light forms uniform light beam emissions without shadow spots effects.

20 Claims, 12 Drawing Sheets

LED AND FIBER OPTIC RING PATHWAY LIGHT

This invention is a Continuation-In-Part of U.S. patent application Ser. No. 13/229,307 filed Sep. 9, 2011, the entire disclosure of which is incorporated by reference in its' entirety.

FIELD OF INVENTION

This invention relates to pathway and landscape lights, in particular to devices, apparatus, systems and methods of using ground directed pathway and landscape lights with a ring configured optical fiber which directs light emissions from a centrally located LED (light emitting diode) light source.

BACKGROUND AND PRIOR ART

Pathway and landscape lighting are known for providing light sources for gardens, walkways, and the like. LEDS (light emitting diodes) have become increasingly popular over the years as a light source since the LEDs have become more cost effective as well as provide for low power consumption and longer life over standard light bulbs, and the like. However, a single LED is still known to emit low levels of light which are impractical for providing sufficient light for gardens and walkways.

The prior art has used clusters of LED (light emitting diodes) together to generate light in pathway and landscape lighting. See for example, U.S. Pat. Nos. D574,532 to Lee et al., 7,204,608 to Beeman et al. and 7,021,787 to Kuelbs (column 10).

However, there are additional problems with the cluster based prior art. FIG. 1 shows a side view of a traditional ground based pathway/landscape light 1 with light source 20 including a centrally located cluster of closely spaced LEDS. The central light source is located on a bottom facing surface 12 underneath a cover 10. An upper end of a light shade lens 30 is also attached to the bottom facing mount surface 12. The light shade lens 30 can have a bottom end attached to a ground engaging post 40 that can additionally have a spiked end that is inserted into the ground to support the pathway/landscape light 1.

FIG. 2 shows the light emissions on a ground surface using a cluster landscape light source. Users have complained about the undesirable shadow spot effects on the ends of each of the surface striking light beams that are emitted from the cluster based landscape lights.

Additionally, users have complained about the light emissions having different levels of illumination on the ground with parts of the light beams. FIG. 2 shows the illumination effects create different levels of brightness on the surface being illuminated. Some of the light emissions are extremely bright and harsh while other parts of the light emissions are very dim. As a result of the dark spots and different levels of illumination of brightness, a ground surface may not be adequately illuminated so that walkers using the path will not have enough light to see obstructions in the path.

Attempts have been made to use other type of arrangements of LEDs for pathways and walkways. See for example, U.S. Patent Application Publication 2006/0203471 to Hodges et al.; 2005/002183 to Wardzala. Hodges is limited to a single linear line of LEDs that projects a line of light. Wardzal uses a ring of LEDs to emit light in a horizontal radial direction. None of the known prior art uses LEDs to direct light in beneath a dome lens covered pathway and landscape light source, where the light is intended to be emitted in a 360 degree direction from the pathway/landscape light. None of the prior art would solve the problem of eliminating shadow effects and different levels of brightness in the light emissions being generated therefrom.

Thus, the need exists for solutions to the above problems with the prior art.

SUMMARY OF THE INVENTION

A primary objective of the present invention is to provide devices, apparatus, systems and methods of using ground directed pathway and landscape lights with perimeter spaced apart LED (light emitting diode) light sources that eliminate undesirable shadow effects from cluster based light sources.

A secondary objective of the present invention is to provide devices, apparatus, systems and methods of using ground directed pathway and landscape lights with perimeter spaced apart LED (light emitting diode) light sources that provide softer and more uniform light emissions from cluster based light sources.

A third objective of the present invention is to provide devices, apparatus, systems and methods of using ground directed pathway and landscape lights with perimeter spaced apart LED (light emitting diode) light sources that provide at least as much if not a greater amount of emitted light than cluster based light sources.

A fourth objective of the present invention is to provide devices, apparatus, systems and methods of using 360 degree emitting surface directed LED (light emitting diode) sources with perimeter spaced apart LED (light emitting diode) light sources that eliminate undesirable shadow effects from cluster based light sources.

A fifth objective of the present invention is to provide devices, apparatus, systems and methods of using 360 degree emitting surface directed LED (light emitting diode) sources with perimeter spaced apart LED (light emitting diode) light sources with perimeter spaced apart LED (light emitting diode) light sources that provide softer and more uniform light emissions from cluster based light sources.

A sixth objective of the present invention is to provide devices, apparatus, systems and methods of using 360 degree emitting surface directed LED (light emitting diode) sources with perimeter spaced apart LED (light emitting diode) light sources that provide at least as much if not a greater amount of emitted light than cluster based light sources.

A novel ground directed pathway light, can include a mount having a front surface with a width and a length and a midportion therebetween, and a perimeter edge about the mount, a plurality of LEDs (light emitting diodes) spaced apart along the perimeter edge of the front surface of the mount arranged in a equally spaced apart configuration, a ground based engaging post attached to the light which extends downward from a midportion of the front surface of the mount, and a power source for providing power to simultaneously illuminate each of the plurality of LEDs directed toward a ground surface.

The light can have a light shade lens having an upper end and a bottom end, the upper end attached to the front surface of the mount, and the ground based engaging post attached to the bottom end of the light shade lens.

The light can also have a single LED attached to the midportion of the mount, the single LED being equally spaced from each of the plurality of LEDs.

The mount can be a disc shape with the LEDS located along the perimeter edge of the disc shape. The LEDs can be arranged in a triangular configuration about the perimeter edge of the disc shape. Three of the LEDs can be arranged in each of the three corners of the triangular configuration about the perimeter edge of the disc shape.

Four of the LEDs can be arranged in a square configuration about the perimeter edge of the disc shape. Four of the LEDs can be arranged in each of the four corners of the square configuration about the perimeter edge of the disc shape.

At least four or more of the LEDs can be arranged in a midportion along each leg of the square configuration about the perimeter edge of the disc shape.

The LEDs can be arranged in a hexagon configuration about the perimeter edge of the disc shape. Five of the LEDs can be arranged in each corner of the hexagon configuration about the perimeter edge of the disc shape.

The mount can have a rectangular shape with the LEDS located along the perimeter edge of the rectangular shape. The mount can have a square shape with the LEDS located along the perimeter edge of the square shape. The mount can have a triangular shape with the LEDS located along the perimeter edge of the triangular shape. The mount can have a hexagon shape with the LEDS located along the perimeter edge of the hexagon shape.

The power source for the light can be a low voltage electrically connected power supply. The power source for the light can be a solar powered connected power supply.

A ground directed pathway light, can include a mount having a front surface with a width and a length and a midportion therebetween, and a perimeter edge about the mount, an LED (light emitting diode) positioned adjacent to a midportion of the front surface of the mount, an optical fiber having a portion circumferentially about the LED light source, a ground based engaging post attached to the light which extends downward from a midportion of the front surface of the mount, and a power source for providing power to simultaneously illuminate the LED and optical fiber which directs light toward a ground surface.

The ground directed pathway light can include a light shade lens having an upper end and a bottom end, the upper end attached to the front surface of the mount, and the ground based engaging post attached to the bottom end of the light shade lens.

The optical fiber can be attached to the front surface of the mount outside of the upper end of the light shade lens. The optical fiber can be attached to the front surface of the mount inside of the upper end of the light shade lens.

The mount can be a disc shape with the LED located adjacent a center location of the disc shape, and the optical fiber is located along the perimeter edge of the disc shape.

The ground directed pathway light can include a light shade lens having an upper end and a bottom end, the upper end attached to the front surface of the mount, and the ground based engaging post attached to the bottom end of the light shade lens.

The optical fiber can be attached to the front surface of the mount outside of the upper end of the light shade lens.

The optical fiber can be attached to the front surface of the mount inside of the upper end of the light shade lens.

The power source can be a low voltage electrically connected power supply. The power source can be a solar powered connected power supply.

A ground directed landscape light can include a mount having a front surface with a diameter and a midportion therebetween, and a perimeter edge about the mount, a first optical fiber arranged in a ring configuration adjacent to the perimeter edge, a ground based engaging post attached to the light which extends downward from a midportion of the front surface of the mount, a light shade lens having an upper end and a bottom end, the upper end attached to the front surface of the mount, and the ground based engaging post attached to the bottom end of the light shade lens, and a power source for providing power to illuminate the optical fiber which directs light toward a ground surface.

The mount can be a disc shape. The optical fiber can be attached to the front surface of the mount outside of the upper end of the light shade lens. The optical fiber can be attached to the front surface of the mount inside of the upper end of the light shade lens. The power source can be a low voltage electrically connected power supply. The power source can be a solar powered connected power supply.

The ground directed landscape light can include an LED (light emitting diode) positioned adjacent to a midportion of the front surface of the mount. The ground directed landscape light can include a plurality of LEDS attached to the disc adjacent to the midportion of the front surface of the mount.

The ground directed landscape light can include a second optical fiber arranged in a ring configuration, with the first optical fiber positioned inside of the light shade lens, and the second optical fiber positioned outside of the light shade lens.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention is a Continuation-In-Part of U.S. patent application Ser. No. 13/229,307 filed Sep. 9, 2011, which is incorporated by reference.

A LISTING OF COMPONENTS IN THE FIGURES WILL NOW BE DESCRIBED

Figure 1:
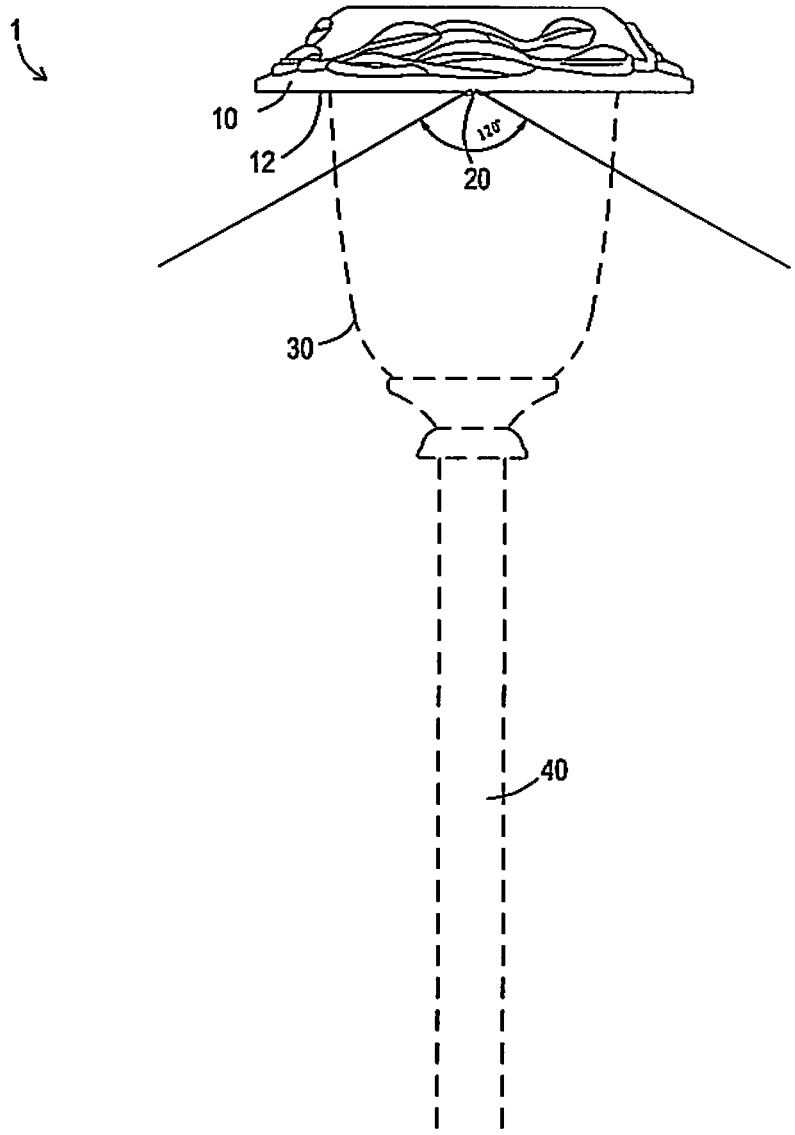
FIG. 1 (PRIOR ART)
FIG. 1 is a prior art view showing the light emissions on a ground surface using a cluster landscape light source with ground engaging post.
Figure 2:
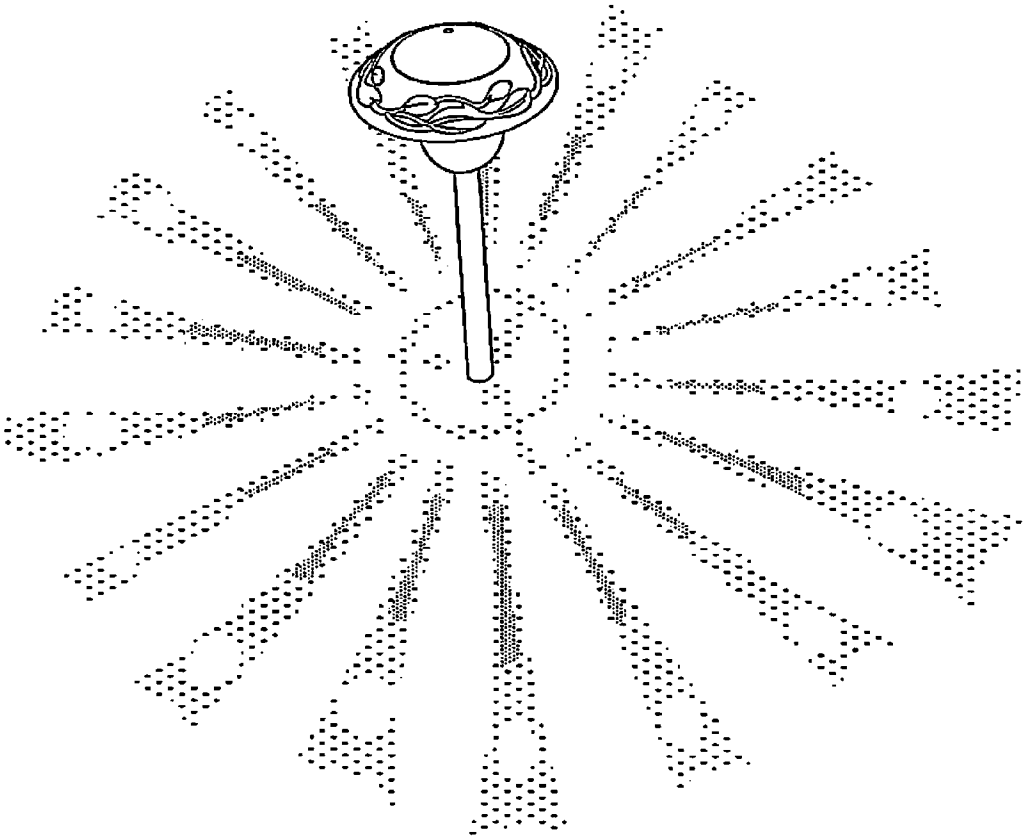
FIG. 2 (PRIOR ART)
FIG. 2 shows the light emissions on a ground surface using a pathway and landscape light with the novel perimeter located spaced apart LED light sources.
Figure 3:
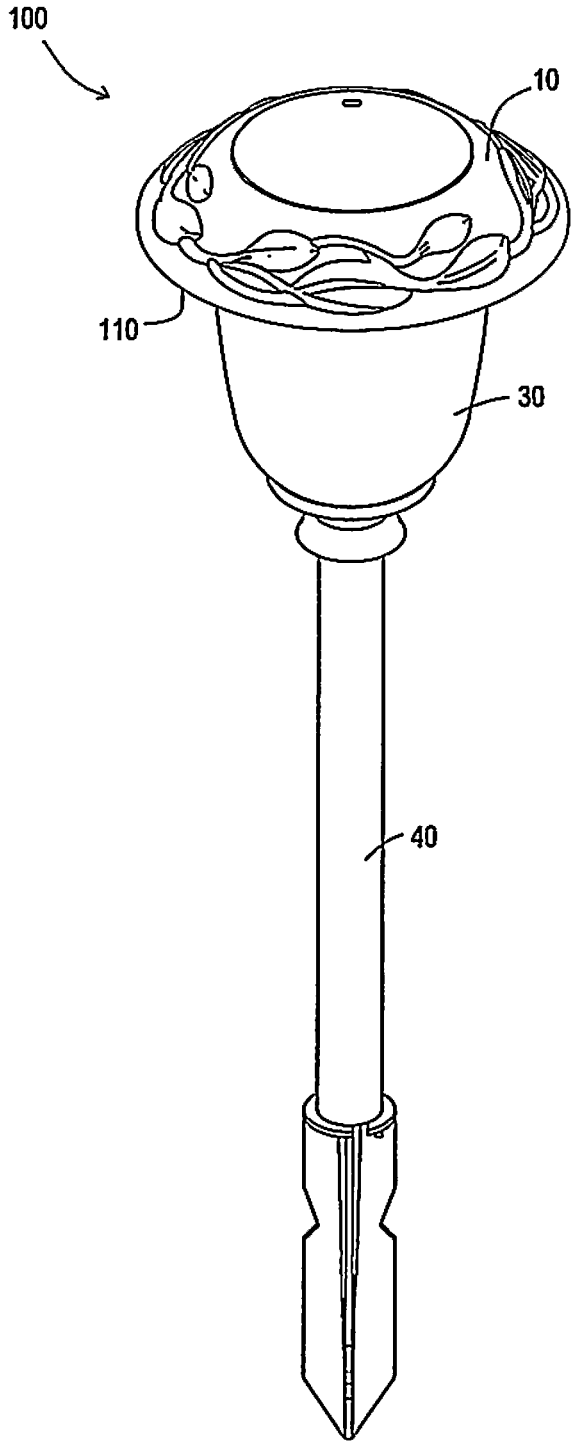
FIG. 3 is a perspective upper front exterior view of the novel pathway/landscape light with ground engaging post.
Figure 4:
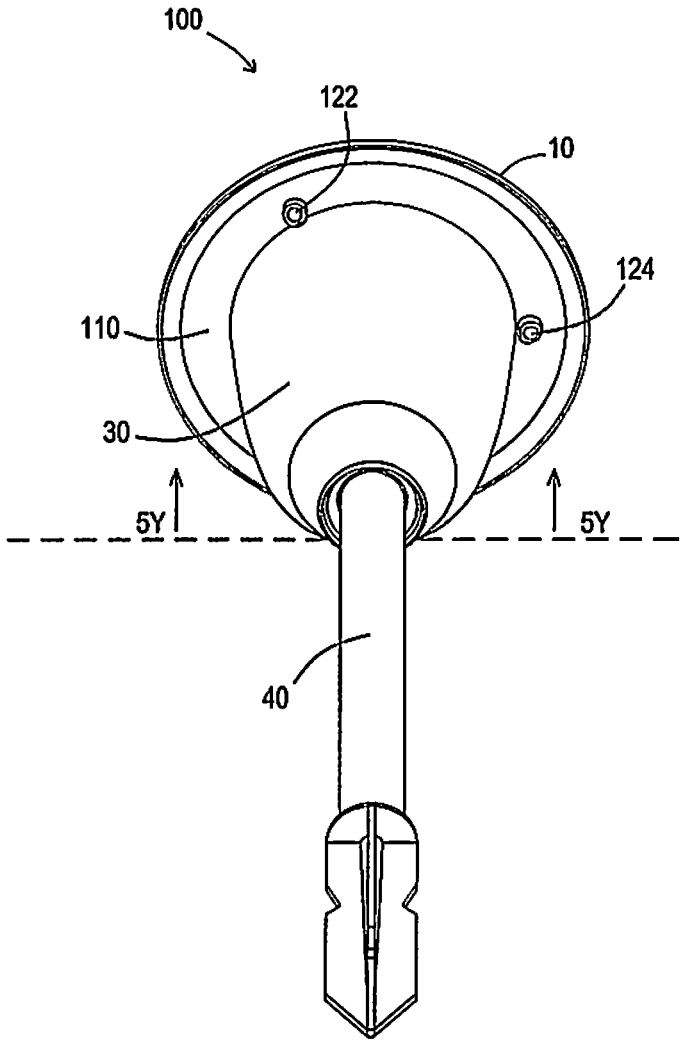
FIG. 4 is a perspective lower front exterior view of the light of FIG. 3.
Figure 5:
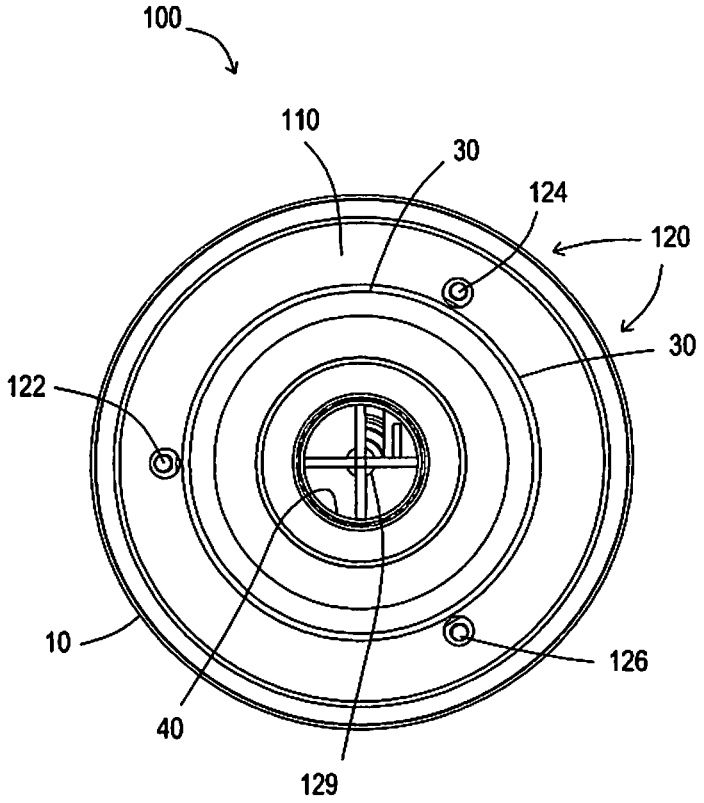
FIG. 5 is a bottom cross-sectional view of the light of FIG. 4 along arrows 5Y.
Figure 6:
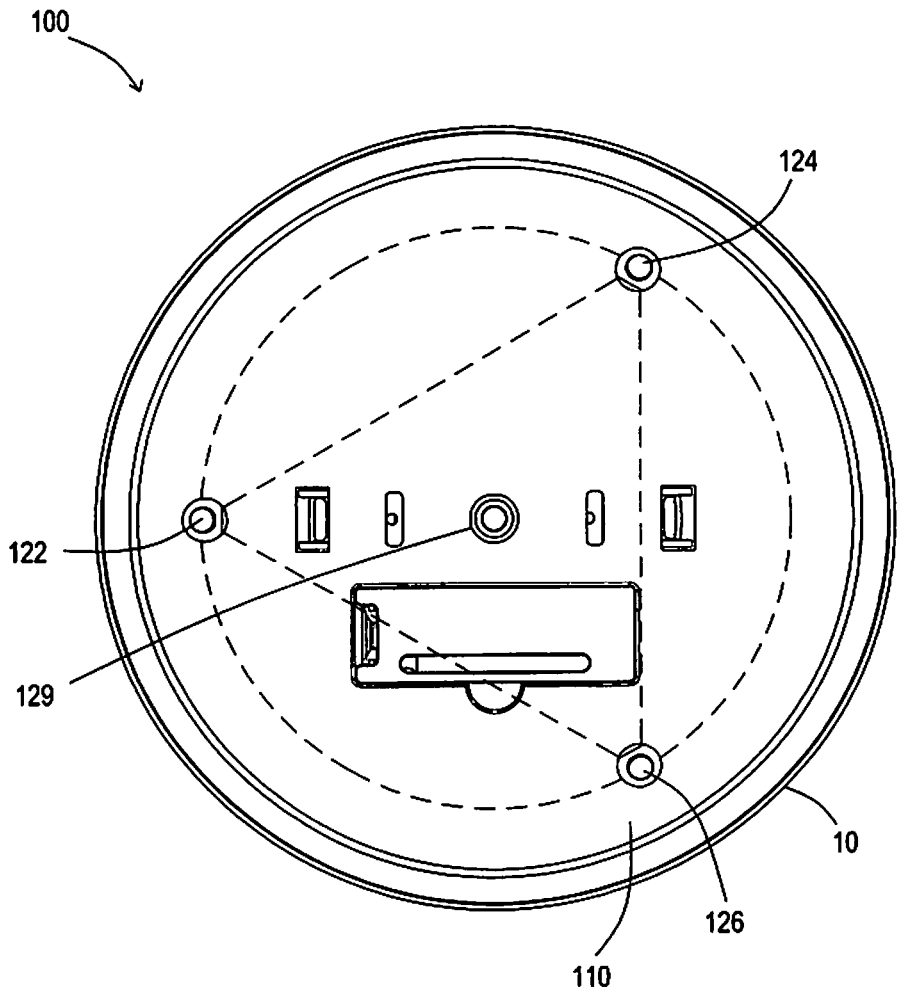
FIG. 6 is another bottom view of the mount of FIG. 5 without the light shade lens and without the ground engaging post.

1. prior art version of pathway light
10. cover of pathway light
12. bottom facing mount surface
20. centrally located cluster of LEDs
30. light shade lens
40. ground engaging post
100. first embodiment of plurality of perimeter configured LEDS
110. bottom surface of mount
120. plurality of perimeter attached LEDs.
122. first LED
124. second LED
126. third LED
129. centrally located LED
200. square and rectangular arrangement of LEDs
210. bottom surface of the mount
300. hexagon arrangement of LEDs
310. bottom surface of the mount
400. Optical Fiber Ring about single or plural LEDS
405. lower hanging perimeter edge of light cover
410. bottom surface of mount
420. centrally located LED
430. optical fiber in ring configuration.
432. input for optical fiber
434. input end of optical fiber
438. outer end of optical fiber
440. light shade lens
442. base of light shade lens
450. mounting post FIG. 3 is a perspective upper front exterior view of the novel pathway/landscape light 100 with ground engaging post 40. FIG. 4 is a perspective lower front exterior view of the light 100 of FIG. 3. FIG. 5 is a bottom cross-sectional view of the light 100 of FIG. 4 along arrows 5Y. FIG. 6 is another bottom view of the mount 110 of FIG. 5 without the light shade lens 30 and without the ground engaging post 40. The novel embodiment can use well known drive circuits to operate the plurality of LEDs, such as those described in U.S. Pat. Nos. 4,866,430 to Chek; 7,559,674 to He et al.; 7,021,787 to Kuelbs (column 10) and U.S. Published Patent Application 2010/0084985 to Woytowitz, which are all incorporated by reference.

The pathway/landscape light can be powered by low voltage. Alternatively, the pathway/landscape light can be solar powered where a battery is solar charged during the day to run the LEDs after dark.

Referring to FIGS. 3-6, the light shade lens 30 can have an upper end attached to a lower facing surface 110 of the mount, and a bottom end attached to a ground engaging post 40. The light shade lens 30 can have a generally upside down dome shape. Alternatively, the light shade lens 30 can have a generally cylindrical shape. Still furthermore, the light shade lens 30 can have a generally tubular shape with the upper end having a wider diameter than the bottom end. The light shade lens 30 can be clear glass or plastic, and/or have etched patterns, and the like, where light passing through the lens 30 and/or reflecting and/or refracting with the lens 30 can cause prism effects that result in expanding light beam emissions therefrom.

With the invention, the light shade lens 30 can have upper edges attached to the mount surface 110 inside the perimeter arrangement of a plurality of LEDS 120. Alternatively, the light shade lens 30 can have upper edges attached to the mount surface 110 outside the perimeter arrangement of the plurality of LEDS 120.

The mount 110 with lower surface can have a disc shape, with the plurality of LEDs 120 arranged in a triangular arrangement, with three LEDs 122, 124, 126 equally spaced apart about the perimeter of the mount surface 110. With approximately 5 inch diameter mount surface 110, the LEDS can be arranged to each be approximately 3.7 inches apart from one another. Additionally, the LEDS 122, 124, 126 can be spaced up to approximately 5 inches apart from one another on the approximately 5 inch diameter mount surface 110. With the triangular arrangement, three LEDs 122, 124, 126 can be located in each of the three corners of the triangular arrangement. Additional LEDs can be located in mid-portions along each of the three legs of the triangular arrangement so that all LEDs remain equally spaced apart from one another.

An additional version of the embodiment 100 can include a centrally located single LED 129 in the disc shaped mount surface 110, where the central LED 129 is located equally distant from the other LEDs 122, 124, 126.

Figure 7:
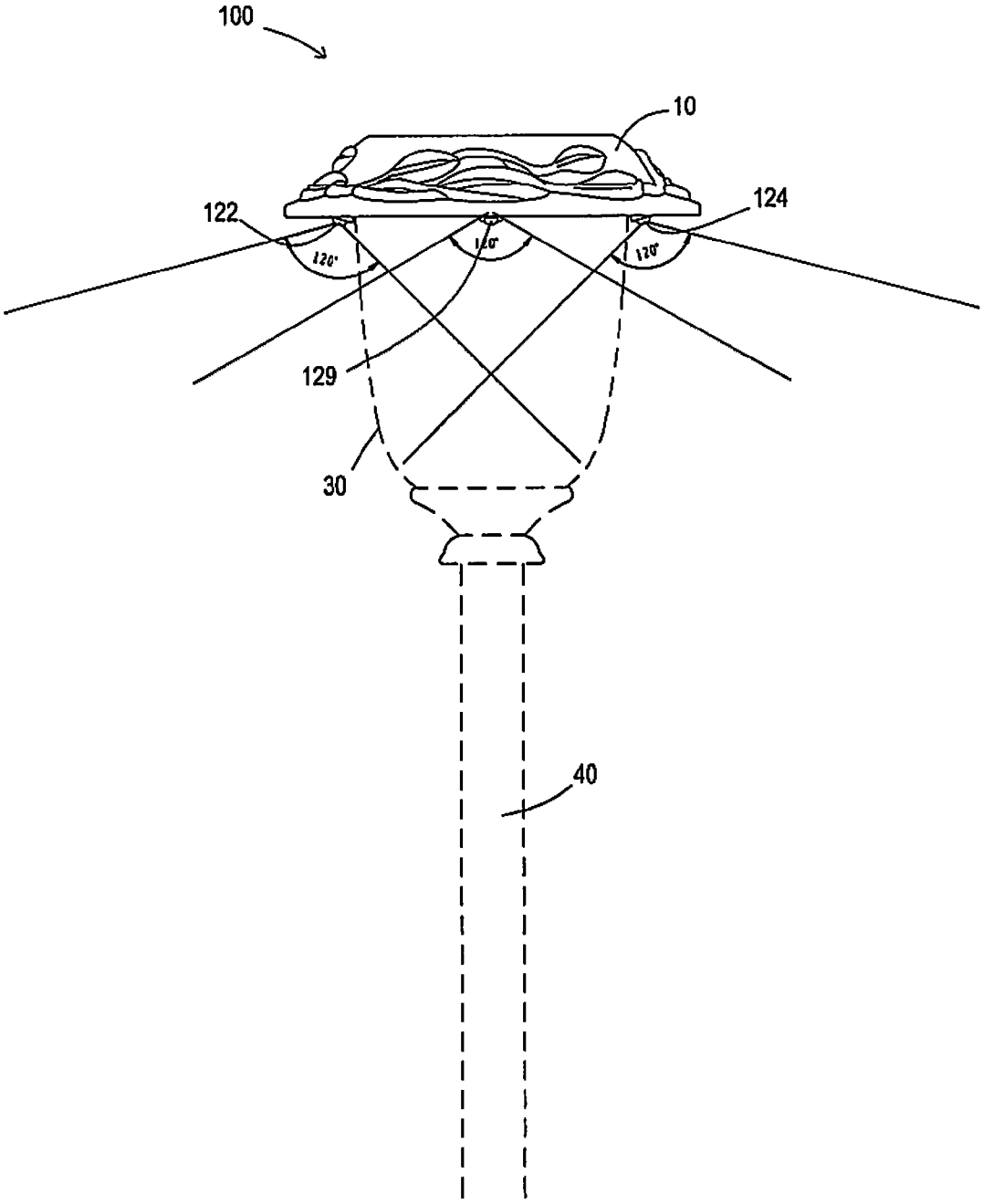
FIG. 7 is a side view of the novel light 100 showing the direction of beams emitting from the perimeter located LEDs.
Figure 8:
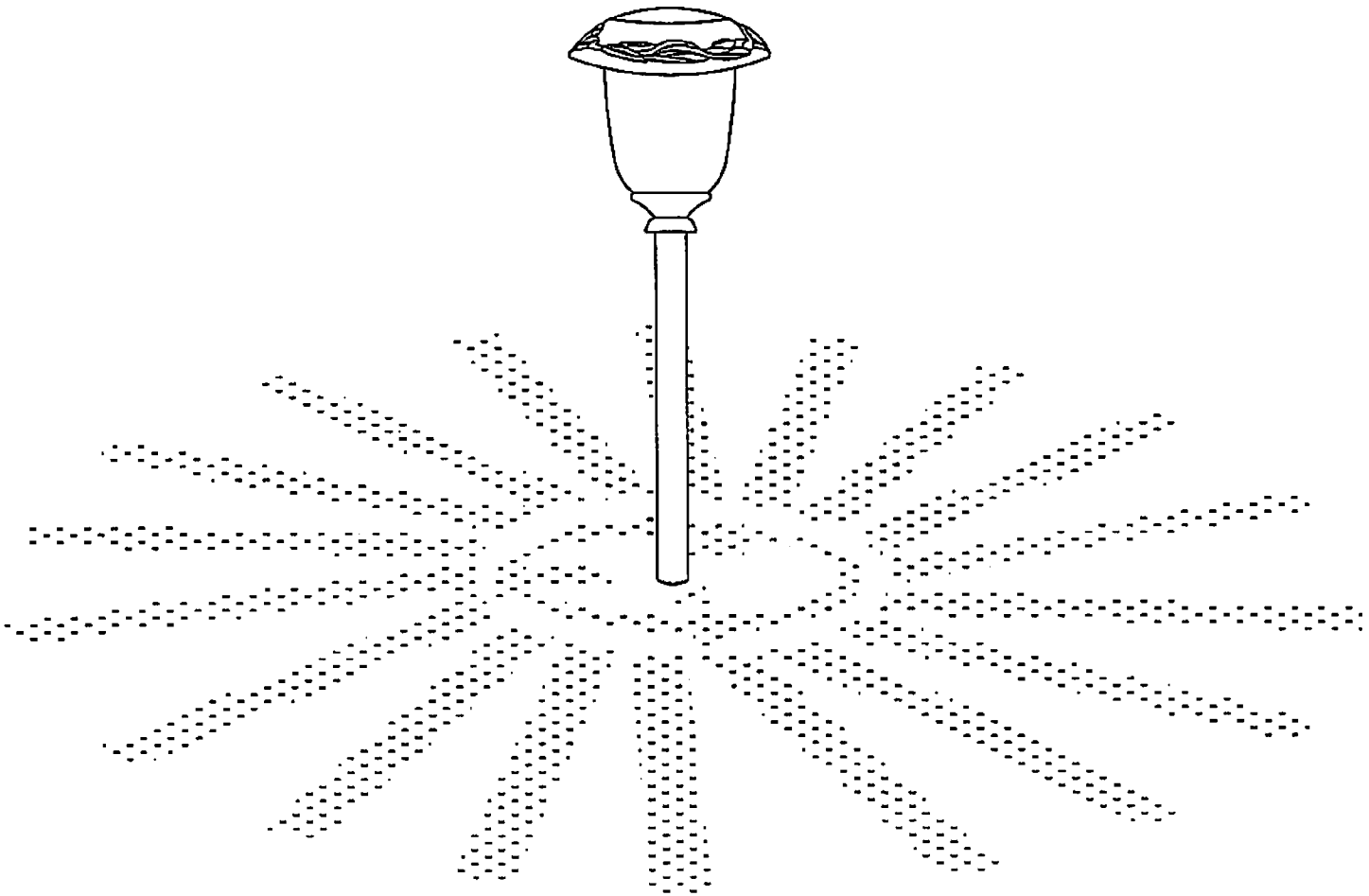
FIG. 8 shows light emissions on a ground surface using the novel pathway/landscape light of FIGS. 3-7.

FIG. 7 is a side view of the novel light 100 showing the direction of beams emitting from the perimeter located LEDs 122, 124 (126 is not shown) and centrally located LED 129. FIG. 8 shows light emissions on a ground surface using the novel pathway/landscape light of FIGS. 3-7. As shown in FIGS. 7-8, the light beams striking a ground surface do not have the dark spots and effects that exist with the prior art. With the invention, the emitted light beams have a generally uniform brightness throughout each of the beams creating a more aesthetic and desirable effect, as well as more thoroughly illuminate an entire ground surface in 360 degrees than the prior art.

Figure 9:
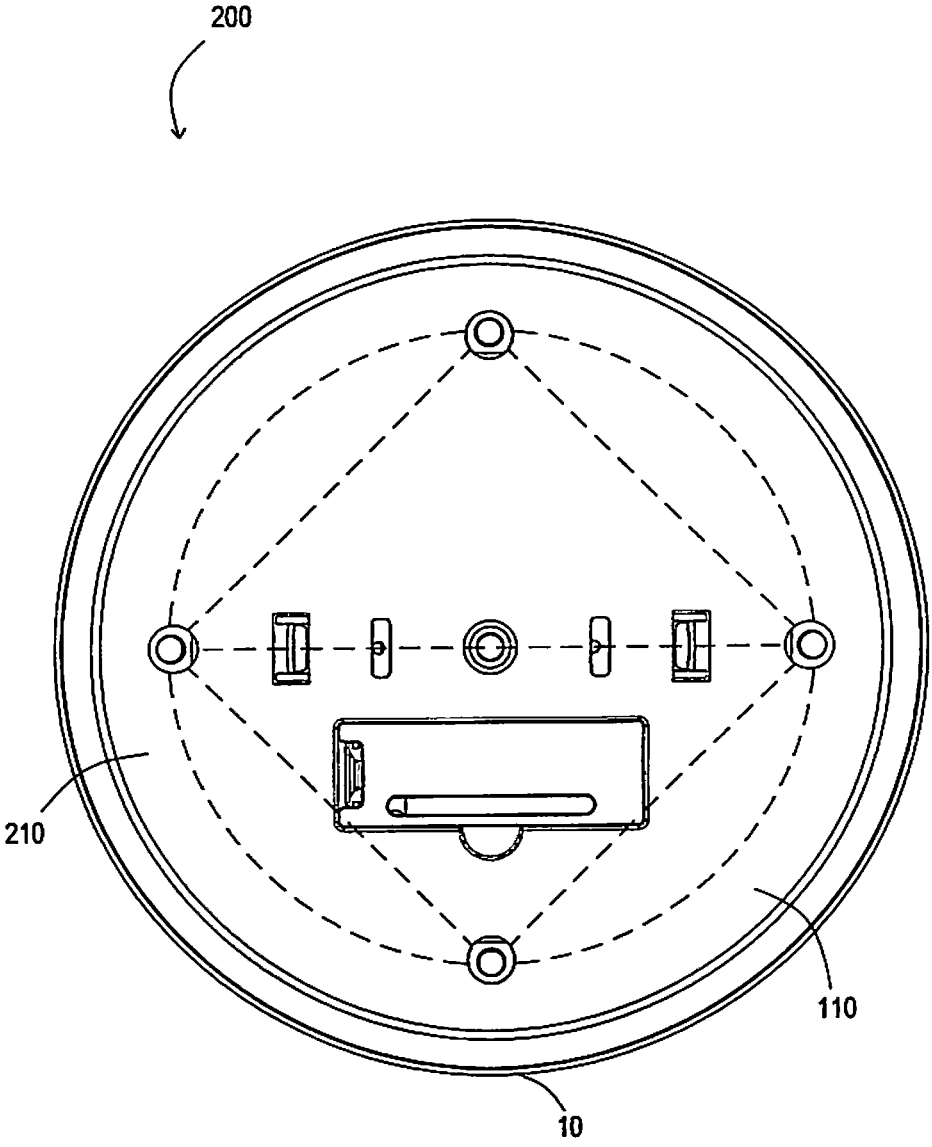
FIG. 9 is a bottom view of another embodiment of a rectangular configuration of LEDs.

FIG. 9 is a bottom view of another embodiment 200 of a rectangular configuration of LEDs. In this embodiment 200, there can be 4 LEDS each located about all 4 corners of a square configuration. An additional central located LED can be optionally located in a mid portion of the mount surface 210. Each the 4 LEDs can be located between approximately 3 inches to approximately 5 inches apart from one another, where the LEDs are equally spaced apart from one another. Additional LEDs can be located on each leg of the square between each of the corner located LEDs.

Figure 10:
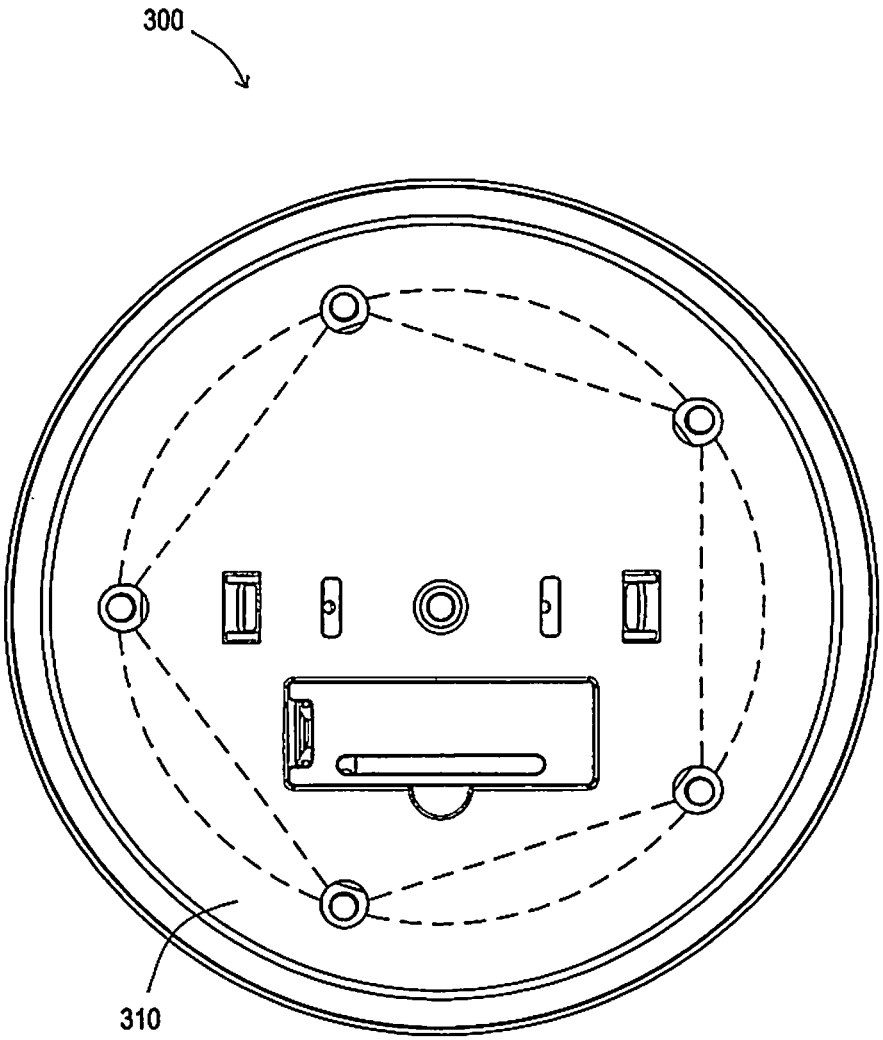
FIG. 10 is a bottom view of another embodiment of a hexagon configuration of LEDs.

FIG. 10 is a bottom view of another embodiment 300 of a hexagon configuration of LEDs. In this embodiment 300, there can be 5 LEDS each located about all 5 corners of a hexagon configuration. An additional central located LED can be optionally located in a mid portion of the mount surface 310. Each the 5 LEDs can be located between approximately 2.5 inches to approximately 5 inches apart from one another, where the LEDs are equally spaced apart from one another. Additional LEDs can be located on each leg of the hexagon between each of the corner located LEDs.

Figure 11:
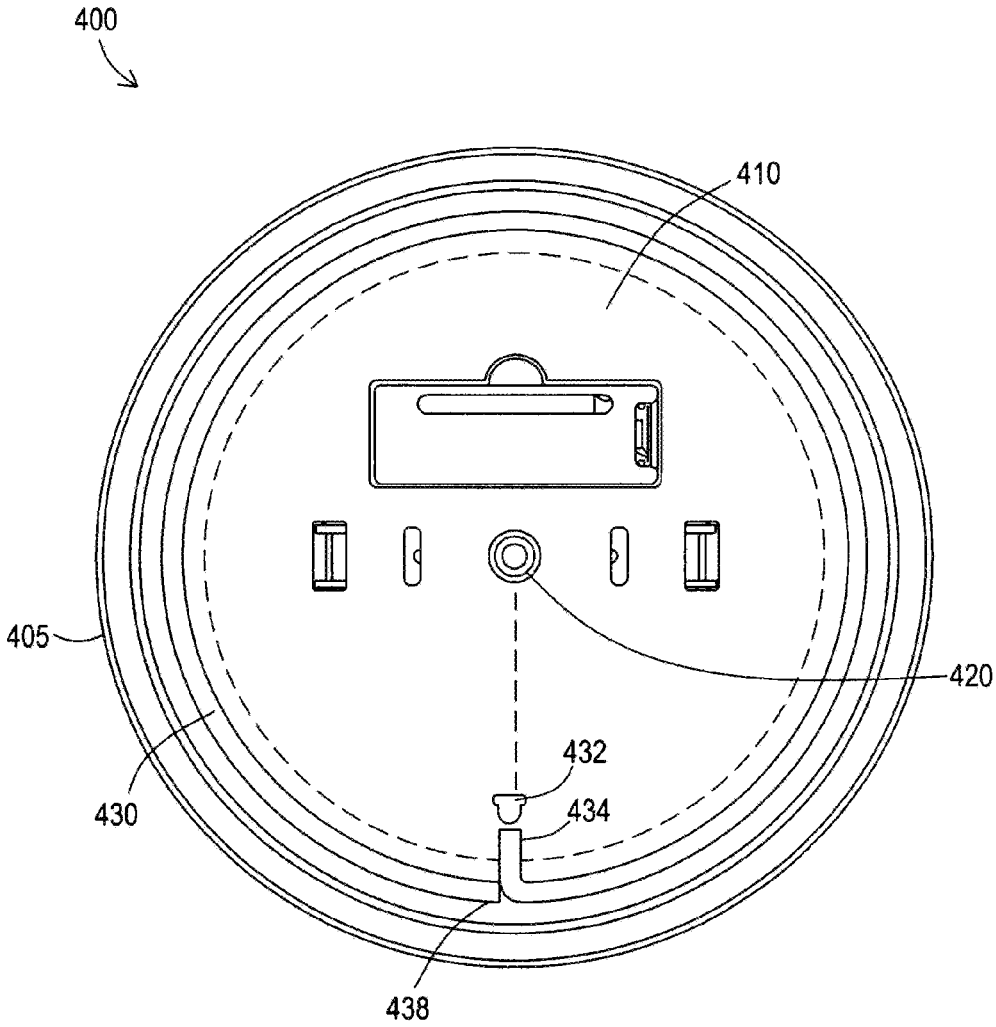
FIG. 11 is a bottom view of an embodiment with a circular optical fiber arranged about a centrally located LED (light emitting diode) in a pathway/landscape light.
Figure 12:
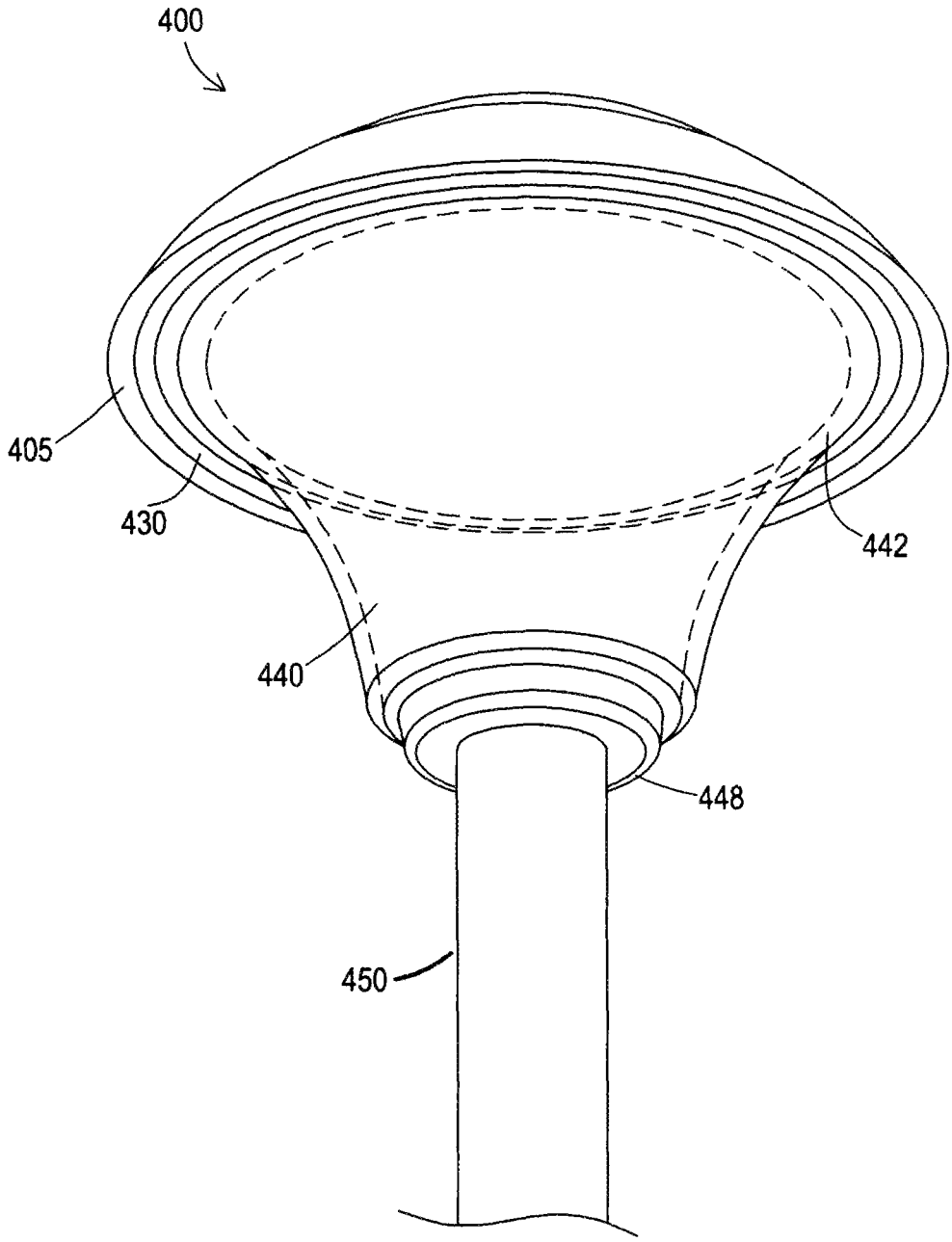
FIG. 12 is a perspective exterior view of the pathway/landscape light of FIG. 11.

FIG. 11 is a bottom view of another embodiment 400 with a circular optical fiber 430 arranged about a centrally located LED (light emitting diode) 420 in a pathway/landscape light. FIG. 12 is a perspective exterior view of the pathway/landscape light 400 of FIG. 11.

Referring to FIGS. 11-12, the pathway/landscape light 400 can include similar features to the previous embodiment which includes a cover with lower hanging perimeter edge 405, and a mount surface 410 for supporting the light sources thereon. Here, a single LED (light emitting diode) 420 can be mounted adjacent to a center point of the disc shaped mount 410. An optical fiber 430 can be arranged in a ring shape about a perimeter edge of the disc shaped mount 410, and have an input end 434 and outer end 438. The optical fiber can be illuminated by the central LED 420 which can illuminate the surrounding light shade 440, which then illuminates the optical fiber 430.

Alternatively, the optical fiber 430 can be illuminated at the input end 434 by a separate light source 432, such as another LED, or by light being directed into the input end 434 by the centrally located LED light source 420.

The embodiment shown in FIG. 12 has the optical fiber 430 mounted in a ring configuration about the exterior of the base portion of the light shade 440. Alternatively, the optical fiber 430 can be mounted along the perimeter of the light shade 440 inside of the base 442 of the light shade 440. Still furthermore, two ring configured optical fibers can be used, with one mounted inside of the base of the light shade lens, and the other mounted outside of the light shade lens.

The bottom 448 of the light shade lens 440 can be attached to a mounting post that has a lower ground engaging end.

While the embodiment in FIGS. 11-12 shows a single central LED light source 420, the invention can be practiced with a cluster of LEDs or with spaced apart LEDs as shown and described in the previous embodiments.

Alternatively, the invention can be practiced with a single optical fiber arranged in a ring shaped configuration about the perimeter edge of the mount of the light without a centrally located LED light source.

Similar to the other embodiments, the novel pathway/landscape light 400 can be powered by low voltage power supplies wired to a household power supply and/or be solar powered, along with a battery for allowing the light 400 to be illuminated at night.

Although the mounts are shown and described as disc shape, the invention can use other mount shapes, such as but not limited to rectangular shaped, square shaped, triangular shaped, hexagon shaped and the like. Other shapes can be used.

Although the preferred embodiment shows and describes ground based pathway/landscape lighting using LEDS with or without an optical fiber ring, the invention can be used with other type of lights that can use 360 degree emitting surface directed LED (light emitting diode) sources with perimeter spaced apart LED (light emitting diode) light sources, where the other types of surfaces to be illuminated such as but not limited to walls, ceilings, and the like.

Although the preferred embodiment shows and describes the light source has having a central ground based stake underneath the downwardly directed light source, the invention can be used with other types of light sources that do not require the central mounting stake, such as but not limited to spotlights, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ground directed pathway light, comprising:

a horizontal mount having a downwardly facing front planar surface with a width and a length and a midportion therebetween, and a perimeter edge about the planar surface of the mount, the mount having an upwardly facing rear surface on an opposite side of the mount;

an LED (light emitting diode) positioned adjacent to and attached to a midportion of the downwardly facing front planar surface of the mount;

an optical fiber having a ring shape circumferentially about the LED light source, the optical fiber being attached to the downwardly facing front planar surface of the mount;

a ground based engaging post having an upper end and a lower end, the upper end attached to the light, and the lower end of the post extending downward from a midportion of the downwardly facing front planar surface of the mount, the lower end of the post adapted for engagement into a ground surface; and a power source for providing power to simultaneously illuminate the LED and optical fiber which directs light toward the ground surface, wherein uniform light emissions without undesirable shadow effects are emitted from the LED and ring shaped optical fiber in approximately 360 degree directions toward the ground surface around the post.

2. The ground directed pathway light of claim 1, further comprising:

a light shade lens having an upper end and a bottom end, the upper end attached to the downwardly facing front planar surface of the mount, and the ground based engaging post attached to the bottom end of the light shade lens.

3. The ground directed pathway light of claim 2, wherein the optical fiber is attached to the downwardly facing front planar surface of the mount outside of the upper end of the light shade lens.

4. The ground directed pathway light of claim 2, wherein the optical fiber is attached to the downwardly facing front planar surface of the mount inside of the upper end of the light shade lens.

5. The ground directed pathway light of claim 1, wherein the mount includes a disc shape with the LED located adjacent a center location on the downwardly facing front planar surface of the disc shape, and the optical fiber is located along the perimeter edge on the downwardly facing front planar surface of the disc shape.

6. The ground directed pathway light of claim 5, further comprising:

a light shade lens having an upper end and a bottom end, the upper end attached to the downwardly facing front planar surface of the disc shape, and the ground based engaging post is attached to the bottom end of the light shade lens.

7. The ground directed pathway light of claim 6, wherein the optical fiber is attached to the downwardly facing front planar surface of the disc shape outside of the upper end of the light shade lens.

8. The ground directed pathway light of claim 6, wherein the optical fiber is attached to the downwardly facing front planar surface of the disc shape inside of the upper end of the light shade lens.

9. The ground directed pathway light of claim 1, wherein the power source is a low voltage electrically connected power supply.

10. The ground directed pathway light of claim 1, wherein the power source is a solar powered connected power supply.

11. A ground directed landscape light, comprising:

a mount having a downwardly facing front planar surface with a diameter and a midportion therebetween, and a perimeter edge about the mount, the mount having an upwardly facing rear surface on an opposite side of the mount;

a first optical fiber arranged in a ring configuration adjacent to the perimeter edge attached to the downwardly facing front planar surface of the mount;

a ground based engaging post having an upper end attached to the light, and a lower end extending extends downward from a midportion of the downwardly facing front planar surface of the mount;

a light shade lens having an upper end and a bottom end, the upper end attached to the downwardly facing front planar surface of the mount, and the upper end of the ground based engaging post attached to the bottom end of the light shade lens, with the lower end of the post adapted for engagement into a ground surface; and a power source for providing power to illuminate the optical fiber which directs light toward the ground surface.

12. The ground directed landscape light of claim 11, wherein the mount includes:

a disc shape with the first optical fiber attached to the downwardly facing front planar surface of the disc shape.

13. The ground directed landscape light of claim 11, wherein the optical fiber is attached to the downwardly facing front planar surface of the disc shape outside of the upper end of the light shade lens.

14. The ground directed landscape light of claim 11, wherein the optical fiber is attached to the downwardly facing front planar surface of the disc shape t inside of the upper end of the light shade lens.

15. The ground directed landscape light of claim 11, wherein the power source is a low voltage electrically connected power supply.

16. The ground directed landscape light of claim 11, wherein the power source is a solar powered connected power supply.

17. The ground directed landscape light of claim 11, further comprising:

an LED (light emitting diode) positioned adjacent to a midportion on the downwardly facing front surface of the mount.

18. The ground directed landscape light of claim 17, further comprising:

a plurality of LEDS attached to the mount adjacent to the midportion attached on the downwardly facing front planar surface of the mount.

19. The ground directed landscape light of claim 11, further comprising:

a second optical fiber arranged in a ring configuration attached to the downwardly facing front planar surface of the mount, with the first optical fiber positioned inside of the light shade lens, and the second optical fiber positioned outside of the light shade lens.

20. The ground directed landscape light of claim 19, further comprising:

an LED (light emitting diode) positioned adjacent to a midportion attached on the downwardly facing front planar surface of the mount.

* * * * *